US010283020B1

(12) United States Patent
Cook et al.

(10) Patent No.: US 10,283,020 B1
(45) Date of Patent: May 7, 2019

(54) TRAFFIC WARNING SIGN

(71) Applicants: Bryan Cook, Tigard, OR (US); Kayla Cook, Tigard, OR (US)

(72) Inventors: Bryan Cook, Tigard, OR (US); Kayla Cook, Tigard, OR (US)

( * ) Notice: Subject to any disclaimer, the term of this patent is extended or adjusted under 35 U.S.C. 154(b) by 16 days.

(21) Appl. No.: 15/658,487

(22) Filed: Jul. 25, 2017

Related U.S. Application Data

(60) Provisional application No. 62/446,522, filed on Jan. 15, 2017.

(51) Int. Cl.

| | |
|---|---|
| ***G09F 13/08*** | (2006.01) |
| ***G09F 13/00*** | (2006.01) |
| ***G08G 1/095*** | (2006.01) |
| ***F21S 9/03*** | (2006.01) |
| ***F21V 23/04*** | (2006.01) |
| ***G09F 13/04*** | (2006.01) |
| ***G09F 13/22*** | (2006.01) |
| *F21Y 115/10* | (2016.01) |

(52) U.S. Cl.
CPC ..... *G09F 13/005* (2013.01); *F21S 9/037* (2013.01); *F21V 23/0464* (2013.01); *F21V 23/0471* (2013.01); *G08G 1/095* (2013.01); *G09F 13/0413* (2013.01); *G09F 13/08* (2013.01); *G09F 13/22* (2013.01); *F21Y 2115/10* (2016.08); *G09F 2013/0472* (2013.01); *G09F 2013/222* (2013.01)

(58) Field of Classification Search
CPC .... G09F 13/005; G09F 13/0413; G09F 13/08; G09F 13/22; F21S 9/027; F21V 23/0464; F21V 23/0471
See application file for complete search history.

(56) References Cited

U.S. PATENT DOCUMENTS

| | | | | |
|---|---|---|---|---|
| 3,720,913 | A | 3/1973 | Bradford | |
| 4,017,189 | A | 4/1977 | Bischoff, Jr. | |
| 5,021,715 | A | 6/1991 | Smith | |
| 8,946,990 | B1 | 2/2015 | Gupta | |
| 9,129,159 | B2 | 9/2015 | Cardoso | |
| D776,553 | S | 1/2017 | Eloyan | |
| 2007/0206375 | A1* | 9/2007 | Piepgras | A43B 1/0027 362/147 |

(Continued)

FOREIGN PATENT DOCUMENTS

WO 2014200382 A1 12/2014

*Primary Examiner* — Douglas W Owens
*Assistant Examiner* — Syed M Kaiser

(57) ABSTRACT

The traffic warning sign is an illuminated display that is monitors the passing of a vehicle. The traffic warning sign determines whether the passing vehicle is in compliance with laws regarding the operation of vehicle headlights of the vehicle. If the traffic warning sign determines that the passing vehicle is not in compliance with the laws regarding the operation of vehicle headlights, the traffic warning sign illuminates a display panel conveying to the vehicle operator a message to turn on the vehicle headlights. The traffic warning sign comprises a housing, a display panel, and a control system. The control system controls the illumination of the display panel. The display panel is a translucent structure that is backlit. When illuminated, the display panel displays an indicia that conveys the sentiment to turn on the vehicle headlights. The housing contains the control system and the display panel.

14 Claims, 4 Drawing Sheets

(56) References Cited

U.S. PATENT DOCUMENTS

| | | | | |
|---|---|---|---|---|
| 2011/0241545 | A1 | 10/2011 | Miller | |
| 2011/0317448 | A1* | 12/2011 | Podd | B60Q 1/2673 362/628 |
| 2012/0086345 | A1* | 4/2012 | Tran | H05B 33/0845 315/158 |
| 2014/0015421 | A1* | 1/2014 | Mituyasu | H05B 33/08 315/158 |
| 2014/0049983 | A1* | 2/2014 | Nichol | G02B 6/0018 362/610 |
| 2014/0130387 | A1* | 5/2014 | Pod | G09F 9/33 40/575 |
| 2014/0223787 | A1* | 8/2014 | Richmond | G09F 9/33 40/575 |

* cited by examiner

TRAFFIC WARNING SIGN

CROSS REFERENCES TO RELATED APPLICATIONS

This non-provisional application claims priority under 35 USC 119(e) to U.S. provisional application U.S. 62/446,522 filed on Jan. 15, 2017 by the inventor: Bryan Anthony Cook of Tigard Oreg.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of instruments including displays, more specifically, an indicating arrangement for variable information.

SUMMARY OF INVENTION

The traffic warning sign is an illuminated display that is monitors the passing of a vehicle. The traffic warning sign determines whether the passing vehicle is in compliance with laws regarding the operation of vehicle headlights of the vehicle. If the traffic warning sign determines that the passing vehicle is not in compliance with the laws regarding the operation of vehicle headlights, the traffic warning sign illuminates a display panel conveying to the vehicle operator a message to turn on the vehicle headlights. The traffic warning sign comprises a housing, a display panel, and a control system. The control system controls the illumination of the display panel. The display panel is a translucent structure that is backlit. When illuminated, the display panel displays an indicia that conveys the sentiment to turn on the vehicle headlights. The housing contains the control system and the display panel.

These together with additional objects, features and advantages of the traffic warning sign will be readily apparent to those of ordinary skill in the art upon reading the following detailed description of the presently preferred, but nonetheless illustrative, embodiments when taken in conjunction with the accompanying drawings.

In this respect, before explaining the current embodiments of the traffic warning sign in detail, it is to be understood that the traffic warning sign is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the traffic warning sign.

It is therefore important that the claims be regarded as including such equivalent construction insofar as they do not depart from the spirit and scope of the traffic warning sign. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
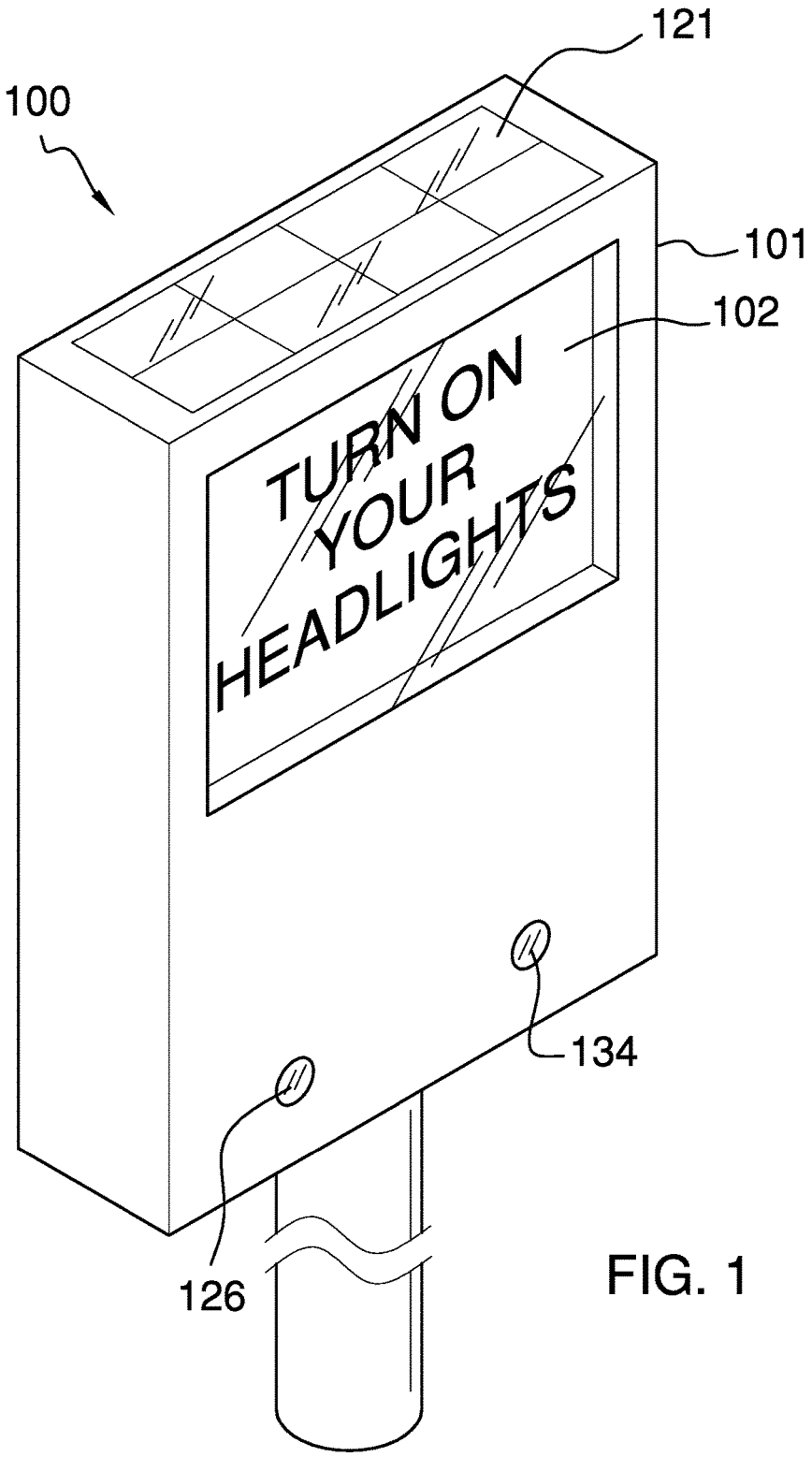
FIG. 1 is a perspective view of an embodiment of the disclosure.
Figure 2:
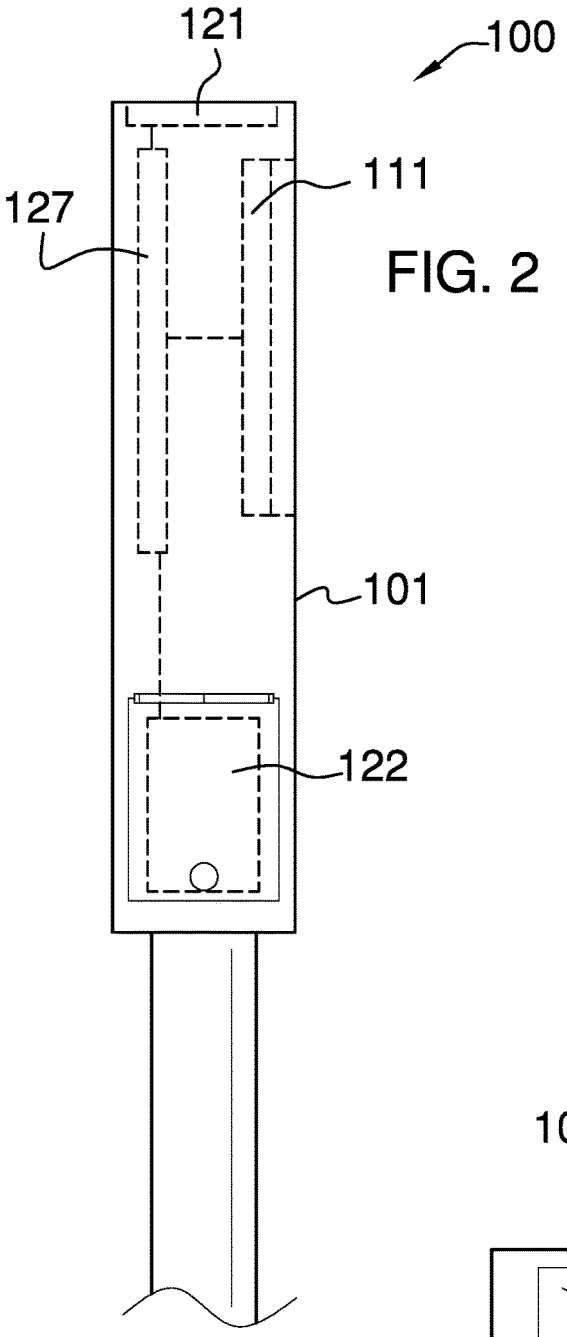
FIG. 2 is a side view of an embodiment of the disclosure.
Figure 3:
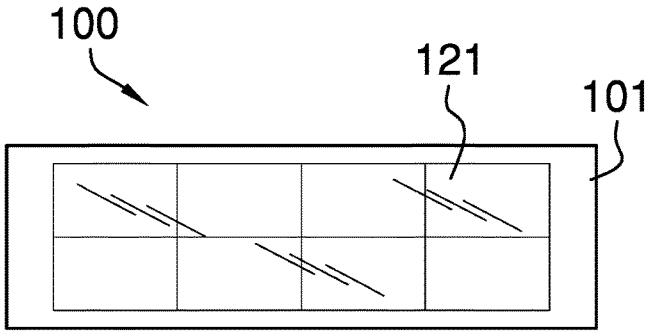
FIG. 3 is a top view of an embodiment of the disclosure.
Figure 4:
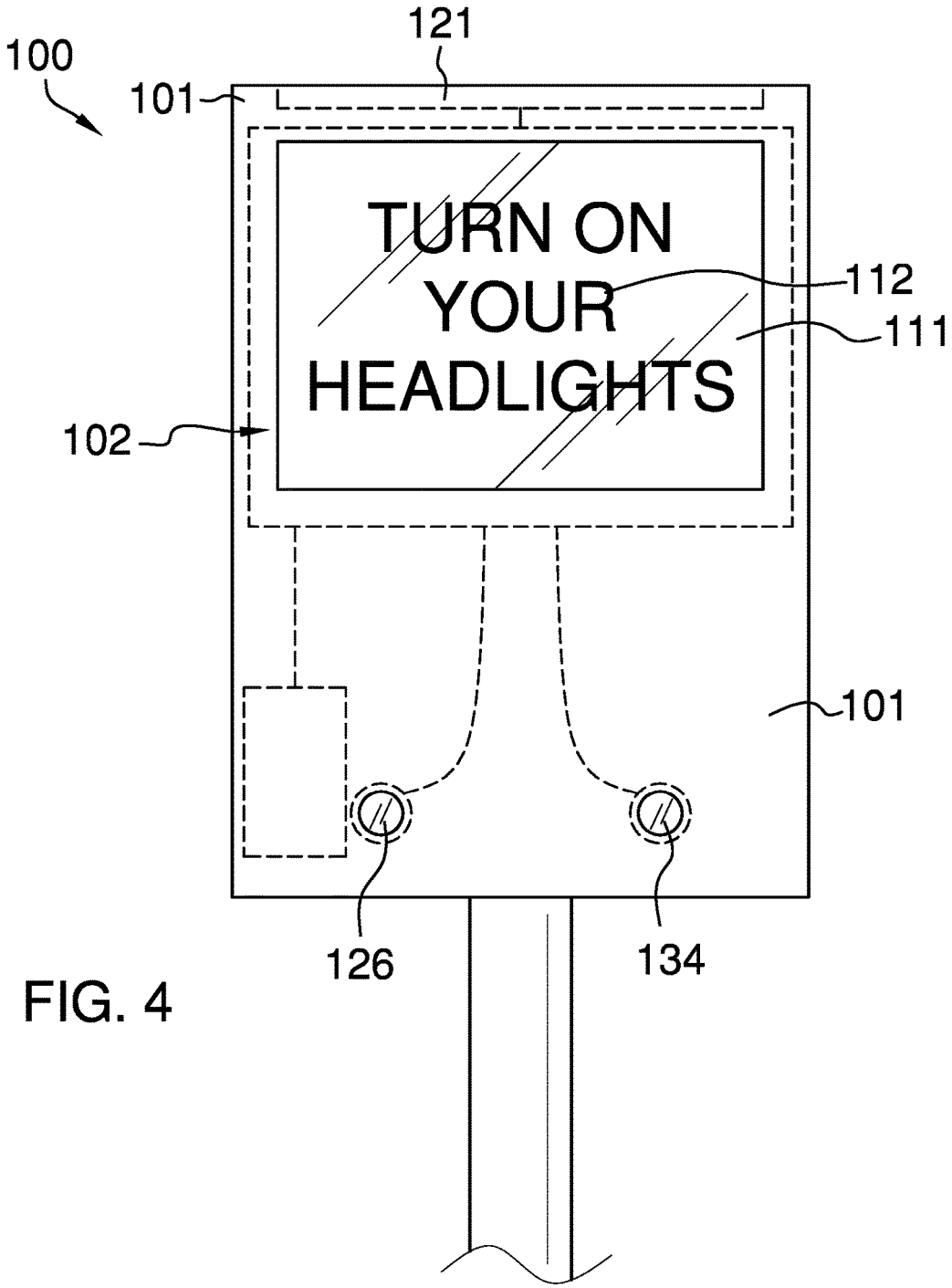
FIG. 4 is a front view of an embodiment of the disclosure.
Figure 5:
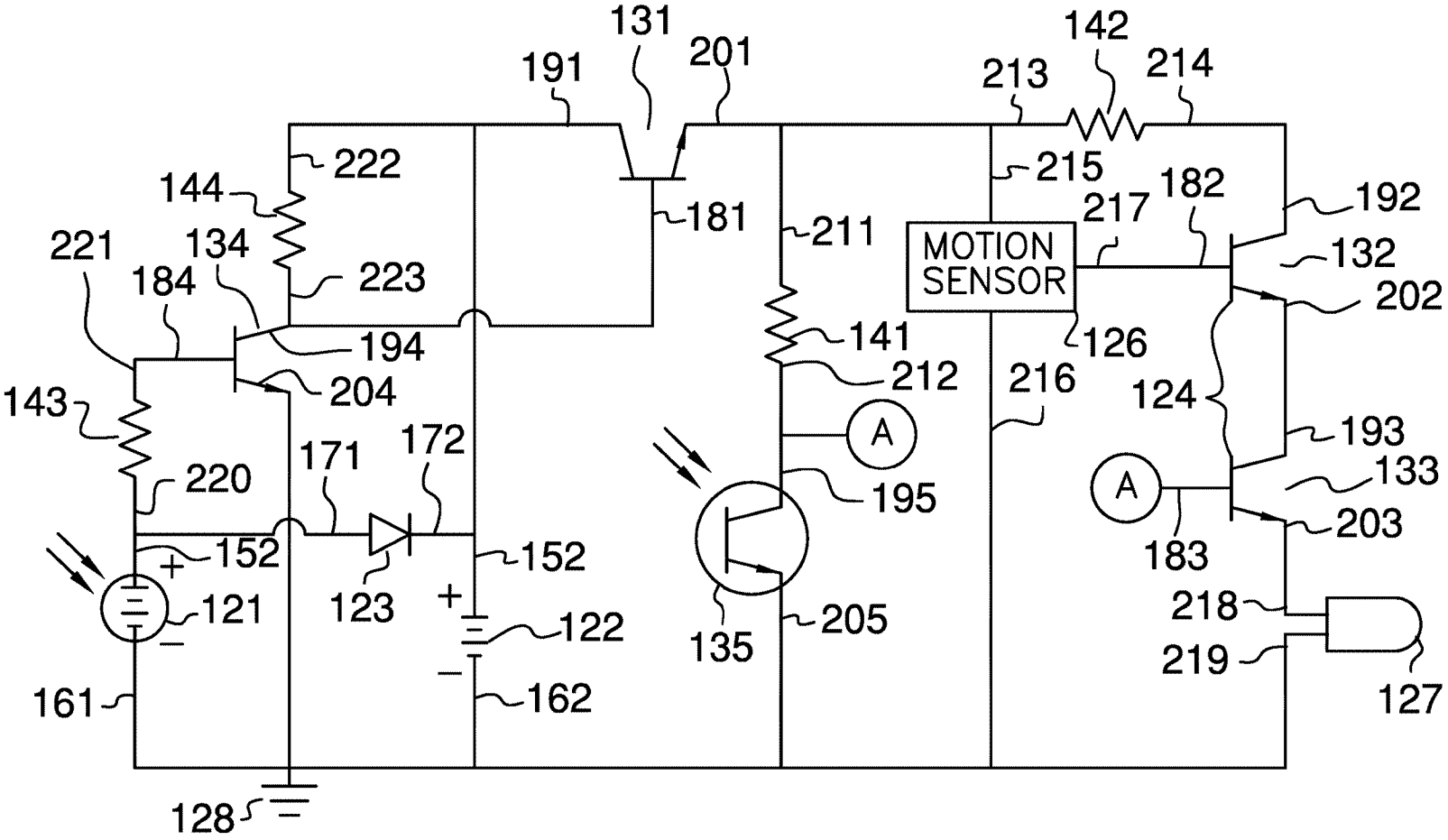
FIG. 5 is a schematic view of an embodiment of the disclosure.

Detailed reference will now be made to one or more potential embodiments of the disclosure, which are illustrated in FIGS. 1 through 5.

The traffic warning sign 100 (hereinafter invention) is an illuminated display that is monitors the passing of a vehicle. The invention 100 determines whether the passing vehicle is in compliance with laws regarding the operation of vehicle headlights of the vehicle. If the invention 100 determines that the passing vehicle is not in compliance with the laws regarding the operation of vehicle headlights, the invention 100 illuminates a display panel 102 conveying to the vehicle operator a message to turn on the vehicle headlights. The invention 100 comprises a housing 101, a display panel 102, and a control system 103. The control system 103 controls the illumination of the display panel 102. The display panel 102 is a translucent plate 111 structure that is backlit. When illuminated, the display panel 102 displays an indicia 112 that conveys a sentiment to turn on the vehicle headlights. The housing 101 contains the control system 103 and the display panel 102.

The housing 101 is a rigid and water impermeable casing within which the display panel 102 and the control system 103 are contained. The housing 101 is formed with all apertures and form factors necessary to allow the housing 101 to accommodate the use and operation of the invention 100. In the first potential embodiment of the disclosure, the housing 101 is formed in the shape of a rectangular block. Method to form the housing 101 are well known and documented in the mechanical arts.

The display panel 102 is a placard displaying the indicia 112 conveying a sentiment that the vehicle headlights should be illuminated. The display panel 102 comprises a translucent plate 111 and an indicia 112. The translucent plate 111 is a rectangular block structure that is formed from a translucent material. The translucent plate 111 is mounted in the housing 101 such that light generated from the control system 103 will pass through the translucent plate 111 to visibly illuminate the indicia 112 formed on the translucent plate 111. The indicia 112 is formed on the translucent plate 111 from an opaque material. The shadow created by the indicia 112 as the translucent plate 111 is illuminated creates the symbol for a sentiment suggesting that the vehicle headlights be illuminated. Methods to apply and indicia 112 to a translucent plate 111 are well known and documented in the sign making arts.

The control system 103 is an electrical circuit that illuminates the display panel 102 when it is determined that vehicle headlight use is required. The control system 103: 1) monitors the level of lighting within the environment; 2) monitors the environment for the motion of a vehicle; and, 3) monitors the area where motion is detected for a source of light. Should the control system 103 detect motion in conditions where: 1) environmental light conditions are low enough to warrant the use of vehicle headlights; and, 2) the detected motion is not generating a point source of light then the control system 103 will illuminate the display panel 102.

The control system 103 comprises a photovoltaic cell 121, a battery 122, a diode 123, a plurality of transistors 124, a plurality of limit resistors 125, a motion sensor 126, a lamp 127, and an electrical ground 128. The photovoltaic cell 121 is further defined with a first positive terminal 151 and a first negative terminal 161. The battery 122 is further defined with a second positive terminal 152 and a second negative terminal 162. The diode 123 is further defined with a diode anode 171 and a diode cathode 172. The lamp 127 is further defined with an eighth lead 218 and a ninth lead 219.

The motion sensor 126 is a commercially available infrared sensor that that detects the motion of vehicles passing the invention 100. The first potential embodiment of the disclosure uses a Hanse Electronics SE10 motion detector as the motion sensor 126. The motion sensor 126 is further defined with a fifth lead 215, a sixth lead 216, and a seventh lead 217. The fifth lead 215 is the power input terminal for the motion sensor 126. The sixth lead 216 is the electrical ground 128 terminal for the motion sensor 126. The seventh lead 217 is the output of the motion sensor 126. A voltage is applied to the seventh lead 217 when the motion sensor 126 detects motion.

The photovoltaic cell 121 is an electrical device that directly converts sunlight into electrical energy. The photovoltaic cell 121 recharges the battery 122. The photovoltaic cell 121 is configured such that when the sunlight is adequate to charge the battery 122 the ability of the control system 103 to illuminate the display panel 102 is disabled. When the level of sunlight falls to the point where the photovoltaic cell 121 cannot power the battery 122 the ability of the control system 103 to illuminate the display panel 102 is enabled.

The battery 122 is a commercially available rechargeable battery 122. The chemical energy stored within the battery 122 is renewed and restored through use of the photovoltaic cell 121. The photovoltaic cell 121 is an electrical circuit that reverses the polarity of the battery 122 and provides the energy necessary to reverse the chemical processes that the battery 122 initially used to by the battery 122 generate the electrical energy. This reversal of the chemical process creates a chemical potential energy that will later be used to generate electricity. The diode 123 is an electrical device that allow current to flow in only one direction. The diode 123 is installed between the battery 122 and the photovoltaic cell 121 such that electricity will not flow from the positive terminal 152 of the battery 122 to the positive terminal 151 of the photovoltaic cell 121.

The lamp 127 is a commercially available electrical device that generates illumination that is transmitted through the translucent plate 111. In the first potential embodiment of the disclosure, the lamp 127 comprises a commercially available LED strip.

The electrical ground 128 is a reference voltage used throughout the electrical circuit that forms the control system 103.

Each of the plurality of transistors 124 is an electrical device that implements the logic of the control system 103. The plurality of transistors 124 comprises a first transistor 131, a second transistor 132, a third transistor 133, a fourth transistor 134, and a phototransistor 135. The first transistor 131 is further defined with a first base 181, a first collector 191, and a first emitter 201. The second transistor 132 is further defined with a second base 182, a second collector 192, and a second emitter 202. The third transistor 133 is further defined with a third base 183, a third collector 193, and a third emitter 203. The fourth transistor 134 is further defined with a fourth base 184, a fourth collector 194, and a fourth emitter 204. The phototransistor 135 is further defined with a fifth collector 195, and a fifth emitter 205.

The first transistor 131 is a commercially available transistor that controls current flow through the control system 103. The first transistor 131 is effectively the master switch of the invention 100. The first transistor 131 is triggered by the fourth transistor 134. The second transistor 132 is configured as a switch that controls current flow into the lamp 127. The second transistor 132 is triggered when the motion sensor 126 is activated. The third transistor 133 is configured as a switch that controls current flow into the lamp 127. The third transistor 133 is triggered by the phototransistor 135. The fourth transistor 134 is configured as an inverting circuit that activates the first transistor 131 when the photovoltaic cell 121 is no longer able to generate the voltage required to power the battery 122. The fourth transistor 134 is triggered by the photovoltaic cell 121.

The phototransistor 135 is a commercially available phototransistor 135 that monitors the field of view monitored by the motion sensor 126. If the phototransistor 135 detects light, the phototransistor 135 opens the switch formed by the third transistor 133 in order to disable the illumination of the lamp 127 under the assumption that the vehicle headlights are on. In order to illuminate the lamp 127, the motion sensor 126 must be activated while the phototransistor 135 is not detecting light.

Each of the plurality of limit resistors 125 is an electrical device that limits the flow of electric current through the control system 103. The plurality of limit resistors 125 comprises a first limit resistor 141, a second limit resistor 142, a third limit resistor 143, and a fourth limit resistor 144. The first limit resistor 141 is further defined with a first lead 211 and a second lead 212. The second limit resistor 142 is further defined with a third lead 213 and a fourth lead 214. The third limit resistor 143 is further defined with a tenth lead 220 and a eleventh lead 221. The fourth limit resistor 144 is further defined with a twelfth lead 222 and a thirteenth lead 223.

The first limit resistor 141 controls current flow into the fifth collector 195 of the phototransistor 135 and the third base 183 of the third transistor 133. The second limit resistor 142 controls current flow into the second collector 192 of the second transistor 132. The third limit resistor 143 controls current flow into the fourth base 184 of the fourth transistor 134. The fourth limit resistor 144 controls current flow into the fourth collector 194 of the fourth transistor 134.

The assembly of the control system 103 is described in the following 4 paragraphs.

The first positive terminal 151 of the photovoltaic cell 121 electrically connects to the diode anode 171 of the diode 123. The first positive terminal 151 of the photovoltaic cell 121 electrically connects to the tenth lead 220 of the third limit resistor 143. The eleventh lead 221 of the third limit resistor 143 electrically connects to the fourth base 184 of the fourth transistor 134. The second positive terminal 152 of the battery 122 electrically connects to the first collector 191 of the first transistor 131. The second positive terminal 152 of the battery 122 electrically connects to the twelfth lead 222 of the fourth limit resistor 144. The second positive terminal 152 of the battery 122 electrically connects to the diode cathode 172 of the diode 123. The thirteenth lead 223 of the fourth limit resistor 144 electrically connects to the fourth collector 194 of the fourth transistor 134.

The first emitter 201 of the first transistor 131 electrically connects to the first lead 211 of the first limit resistor 141. The first emitter 201 of the first transistor 131 electrically connects to the third lead 213 of the second limit resistor 142. The first emitter 201 of the first transistor 131 electrically connects to the fifth lead 215 of the motion sensor 126. The second lead 212 of the first limit resistor 141 electrically connects to the fifth collector 195 of the phototransistor 135. The fifth collector 195 of the phototransistor 135 electrically connects to the third base 183 of the third transistor 133. The seventh lead 217 of the motion sensor 126 electrically connects to the second base 182 of the second transistor 132.

The fourth lead 214 of the second limit resistor 142 electrically connects to the second collector 192 of the second transistor 132. The second emitter 202 of the second transistor 132 electrically connects to the third collector 193 of the third transistor 133. The third emitter 203 of the third transistor 133 electrically connects to the eighth lead 218 of the lamp 127.

The first negative terminal 161 of the photovoltaic cell 121 electrically connects to the electrical ground 128. The second negative terminal 162 of the battery 122 electrically connects to the electrical ground 128. The fourth emitter 204 of the fourth transistor 134 electrically connects to the electrical ground 128. The fifth emitter 205 of the phototransistor 135 electrically connects to the electrical ground 128. The sixth lead 216 of the motion sensor 126 electrically connects to the electrical ground 128. The ninth lead 219 of the lamp 127 electrically connects to the electrical ground 128.

The following definitions were used in this disclosure:

Battery: As used in this disclosure, a battery is a chemical device consisting of one or more cells, in which chemical energy is converted into electricity and used as a source of power.

Control System: As used in this disclosure, a control system is a first device or system that manages and regulates the behavior or operation of a second device or system.

Diode: As used in this disclosure, a diode is a two terminal semiconductor device that allows current flow in only one direction. The two terminals are called the anode and the cathode. Electric current is allowed to pass from the anode to the cathode.

Display: As used in this disclosure, a display is a surface upon which is presented an image, potentially including, but not limited to, graphic images and text, that is interpretable by an individual viewing the projected image in a meaningful manner.

Electrical Ground: As used in this disclosure, an electrical ground is a common reference voltage that is used in the design and implementation of electrical circuits. An electrical ground is often, but not necessarily, the discharge point of electric currents flowing through an electric circuit.

Field of View: As used in this disclosure, a field of view refers to one or more angles, which delimits an area from which electromagnetic radiation will be sensed by an image sensor.

Form Factor: As used in this disclosure, the term form factor refers to the size and shape of an object.

Housing: As used in this disclosure, a housing is a rigid casing that encloses and protects one or more devices.

Image: As used in this disclosure, an image is an optical representation or reproduction of an indicia or of the appearance of something or someone.

Indicia: As used in this disclosure, the term indicia refers to a set of markings that identify a sentiment.

Lamp: As used in this disclosure, a lamp is a two terminal electrical device that generates visible light to illuminate objects so they can be seen.

Lead: As used in this disclosure, a lead is a conductor that is physically used to electrically connect an electrical component into a larger circuit assembly.

LED: As used in this disclosure, an LED is an acronym for a light emitting diode. A light emitting diode is a diode that is also a light source.

Limit Resistor: As used in this disclosure, a limit resistor is an electrical resistor that is used to limit the flow of electric current through an electrical circuit.

Opaque: As used in this disclosure, opaque refers to an object or material that prevents the passage of radiation through the object or material.

Photoelectric: As used in this disclosure, photoelectric is an adjective used to describe an electronic component in which the performance of the electronic component is modified by light. Typical photoelectric devices include, but are not limited to, photoelectric transistors, photoelectric diodes, and photoelectric resistors.

Photoswitch: As used in this disclosure, a photoswitch is a switch that is actuated with light. The operation of a photoswitch is often based on the use of a photoelectric device.

Phototransistor: As used in this disclosure, a phototransistor is a two terminal photoelectric device that performs in the manner of a transistor. Specifically, when exposed to light a phototransistor will behave as a transistor with a voltage applied to the base that creates a base current flow into the transistor.

Photovoltaic Cell: As used in this disclosure, a photovoltaic cell is an electrical device that directly converts light energy into electrical energy.

Resistor: As used in this disclosure, a resistor is a well-known and commonly available electrical device that inhibits the flow of electricity through an electric circuit. Within an electric circuit processing alternating currents, the resistor will not affect the phase of the alternating current. A current flowing through a resistor will create a voltage across the terminals of the resistor.

Rectangular Block: As used in this disclosure, a rectangular block refers to a three dimensional structure comprising six rectangular surfaces formed at right angles. Within this disclosure, a rectangular block may further comprise rounded edges and corners.

Rounded: A used in this disclosure, the term rounded refers to the replacement of an apex, vertex, or edge or brink of a structure with a (generally smooth) curvature wherein the concave portion of the curvature faces the interior or center of the structure.

Sentiment: As used in this disclosure, a sentiment refers to a symbolic meaning or message that is communicated through the use of an image, potentially including a text based image.

Terminal: As used in this disclosure, a terminal is the end point of a conductor. A terminal can be the conducting wire itself or may have attached to is a device designed to facilitate an electrical connection.

Transistor: As used in this disclosure, a transistor is a general term for a three terminal semiconducting electrical that is used for electrical signal amplification and electrical switching applications. There are several designs of transistors. A common example of a transistor is an NPN transistor that further comprises a collector terminal, an emitter terminal, and a base terminal and which consists of a combination of two rectifying junctions (a diode is an example of a rectifying junction). Current flowing from the collector terminal through the emitter terminal crosses the two rectifier junctions. The amount of the electric current crossing the two rectified junctions is controlled by the amount of electric current that flows through the base terminal. The transistor operates as switch. When a voltage is applied to the base, a base current will flow into the base and the transistor will act like a closed switch allowing current to flow from the collector to the emitter. When the voltage is removed from the base, the transistor will act like an open switch disrupting current flow from the collector to the emitter.

Translucent: As used in this disclosure, translucent refers to a material that allows light to pass through the material but that significantly scatters the light such that an object cannot be clearly seen through the material.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An indicating arrangement comprising:

a housing, a display panel, and a control system;

the control system controls the illumination of the display panel; wherein the display panel is a translucent plate structure that is backlit;

when illuminated the display panel displays an indicia;

wherein the indicia conveys a sentiment; the housing contains the control system and the display panel;

the housing is a rigid casing; wherein the housing is a water impermeable casing;

the translucent plate is a rectangular block structure;

the translucent plate is formed from a translucent material;

wherein the translucent plate is mounted in the housing such that light generated from the control system will pass through the translucent plate to visibly illuminate the indicia formed on the translucent plate;

the indicia is formed an opaque material;

the control system is an electrical circuit;

the control system monitors the level of lighting within the environment;

the control system further monitors the area where motion is detected for a source of light; wherein the control system comprises a photovoltaic cell, a battery, a diode, a plurality of transistors, a plurality of limit resistors, a motion sensor, a lamp, and an electrical ground;

the photovoltaic cell, the battery, the diode, the plurality of transistors, the plurality of limit resistors, the motion sensor, the lamp, and the electrical ground are electrically interconnected;

wherein the photovoltaic cell is further defined with a first positive terminal and a first negative terminal; wherein the battery is further defined with a second positive terminal and a second negative terminal;

wherein the diode is further defined with a diode anode and a diode cathode; wherein the lamp is further defined with an eighth lead and a ninth lead; and the motion sensor is an infrared sensor; wherein the motion sensor is further defined with a fifth lead, a sixth lead, and a seventh lead.

2. The indicating arrangement according to claim 1 wherein the photovoltaic cell is an electrical device that converts sunlight into electrical energy;

the photovoltaic cell recharges the battery;

wherein the photovoltaic cell is configured such that when the sunlight is adequate to charge the battery the ability of the control system to illuminate the display panel is disabled;

the photovoltaic cell is further configured such that when the level of sunlight falls to the point where the photovoltaic cell cannot power the battery the ability of the control system to illuminate the display panel is enabled; and wherein the electrical ground is a reference voltage.

3. The indicating arrangement according to claim 2, wherein the diode is an electrical device that allow current to flow in only one direction; and the diode is installed between the battery and the photovoltaic cell such that electricity will not flow from the positive terminal of the battery to the positive terminal of the photovoltaic cell.

4. The indicating arrangement according to claim 3 wherein the lamp is an electrical device that generates the illumination that is transmitted through the translucent plate.

5. The indicating arrangement according to claim 4 wherein each of the plurality of transistors is an electrical device that implements the logic of the control system.

6. The indicating arrangement according to claim 5, wherein the plurality of transistors comprises a first transistor, a second transistor, a third transistor, a fourth transistor, and a phototransistor; the first transistor is the master switch of the indicating arrangement;

the second transistor is configured as a switch that controls current flow into the lamp; the third transistor is configured as a switch that controls current flow into the lamp;

the fourth transistor is configured as an inverting circuit; the first transistor is further defined with a first base, a first collector, and a first emitter;

the second transistor is further defined with a second base, a second collector, and a second emitter;

the third transistor is further defined with a third base, a third collector, and a third emitter;

the fourth transistor is further defined with a fourth base, a fourth collector, and a fourth emitter; and the phototransistor is further defined with a fifth collector, and a fifth emitter.

7. The indicating arrangement according to claim 6, wherein the first transistor is triggered by the fourth transistor;

the second transistor is triggered when the motion sensor is activated; the third transistor is triggered by the phototransistor; and the fourth transistor is triggered by the photovoltaic cell; wherein the phototransistor is triggered by light.

8. The indicating arrangement according to claim 7, wherein the plurality of limit resistors comprises a first limit resistor, a second limit resistor, a third limit resistor, and a fourth limit resistor;

each of the plurality of limit resistors is an electrical device that limits the flow of electric current through the control system;

the first limit resistor is further defined with a first lead and a second lead;

the second limit resistor is further defined with a third lead and a fourth lead;

the third limit resistor is further defined with a tenth lead and a eleventh lead; and the fourth limit resistor is further defined with a twelfth lead and a thirteenth lead.

9. The indicating arrangement according to claim 8, wherein the first limit resistor controls current flow into the fifth collector of the phototransistor and the third base of the third transistor;

the second limit resistor controls current flow into the second collector of the second transistor;

the third limit resistor controls current flow into the fourth base of the fourth transistor; and the fourth limit resistor controls current flow into the fourth collector of the fourth transistor.

10. The indicating arrangement according to claim 9, wherein the first positive terminal of the photovoltaic cell electrically connects to the diode anode of the diode;

the first positive terminal of the photovoltaic cell electrically connects to the tenth lead of the third limit resistor;

the eleventh lead of the third limit resistor electrically connects to the fourth base of the fourth transistor;

the second positive terminal of the battery electrically connects to the first collector of the first transistor;

the second positive terminal of the battery electrically connects to the twelfth lead of the fourth limit resistor; and the second positive terminal of the battery electrically connects to the diode cathode of the diode; the thirteenth lead of the fourth limit resistor electrically connects to the fourth collector of the fourth transistor.

11. The indicating arrangement according to claim 10, wherein the first emitter of the first transistor electrically connects to the first lead of the first limit resistor;

the first emitter of the first transistor electrically connects to the third lead of the second limit resistor;

the first emitter of the first transistor electrically connects to the fifth lead of the motion sensor;

the second lead of the first limit resistor electrically connects to the fifth collector of the phototransistor;

the fifth collector of the phototransistor electrically connects to the third base of the third transistor; and the seventh lead of the motion sensor electrically connects to the second base of the second transistor.

12. The indicating arrangement according to claim 11, wherein the fourth lead of the second limit resistor electrically connects to the second collector of the second transistor;

the second emitter of the second transistor electrically connects to the third collector of the third transistor; and the third emitter of the third transistor electrically connects to the eighth lead of the lamp.

13. The indicating arrangement according to claim 12, wherein the first negative terminal of the photovoltaic cell electrically connects to the electrical ground;

the second negative terminal of the battery electrically connects to the electrical ground;

the fourth emitter of the fourth transistor electrically connects to the electrical ground;

the fifth emitter of the phototransistor electrically connects to the electrical ground; and the sixth lead of the motion sensor electrically connects to the electrical ground; the ninth lead of the lamp electrically connects to the electrical ground.

14. The indicating arrangement according to claim 13, wherein the housing is formed in the shape of a rectangular block; and the lamp comprises an LED strip.

* * * * *